US007270056B2

(12) United States Patent
Munoz et al.

(10) Patent No.: US 7,270,056 B2
(45) Date of Patent: Sep. 18, 2007

(54) PRINT STRIPPER FOR ESD CONTROL

(75) Inventors: Jesus L. Munoz, General Trias Cavite (PH); Glenn Placido, Dasmarinas Cavite (PH); Leonard U. Ambata, General Trias Cavite (PH)

(73) Assignee: Intel Corporation, Santa Clara, CA (US)

( * ) Notice: Subject to any disclaimer, the term of this patent is extended or adjusted under 35 U.S.C. 154(b) by 23 days.

(21) Appl. No.: 10/930,251

(22) Filed: Aug. 31, 2004

(65) Prior Publication Data

US 2006/0042482 A1 Mar. 2, 2006

(51) Int. Cl.
*B41F 17/00* (2006.01)

(52) U.S. Cl. ..... 101/41; 101/35
(58) Field of Classification Search ..... 101/41, 101/35
See application file for complete search history.

(56) References Cited

U.S. PATENT DOCUMENTS

| | | | | |
|---|---|---|---|---|
| 5,163,551 | A * | 11/1992 | Bhatia | 206/725 |
| 5,173,766 | A * | 12/1992 | Long et al. | 257/687 |
| 5,226,361 | A * | 7/1993 | Grant et al. | 101/44 |
| 5,911,329 | A * | 6/1999 | Wark et al. | 211/41.17 |
| 5,985,377 | A * | 11/1999 | Corbett | 427/511 |
| 6,224,936 | B1 * | 5/2001 | Gochnour et al. | 427/96.2 |
| 6,474,476 | B1 * | 11/2002 | Anderson et al. | 206/725 |
| 6,523,801 | B2 * | 2/2003 | Combs et al. | 248/544 |
| 6,764,877 | B2 * | 7/2004 | Lin et al. | 438/106 |
| 2002/0026877 | A1 * | 3/2002 | Grabotin et al. | 101/41 |
| 2002/0185019 | A1 * | 12/2002 | Tollhupp | 101/41 |
| 2003/0128528 | A1 * | 7/2003 | Matthews | 361/752 |
| 2003/0211813 | A1 * | 11/2003 | Kassir et al. | 451/28 |

* cited by examiner

*Primary Examiner*—Anthony H. Nguyen
(74) *Attorney, Agent, or Firm*—Buckley, Maschoff & Talwalker LLC

(57) ABSTRACT

A system may include a static dissipative device to secure a semiconductor component, and a printer to print indicia on the semiconductor component while the semiconductor component is secured with the static dissipative device.

11 Claims, 6 Drawing Sheets

PRINT STRIPPER FOR ESD CONTROL

BACKGROUND

A conventional semiconductor product such as an integrated circuit is marked with indicia during or after its manufacture. The indicia typically include a part number that identifies the semiconductor product, and may also include a company logo, operating specifications or other related information. Laser printing, etching, and ink pad printing have each been employed to place indicia on an integrated circuit.

According to some types of ink pad printing, a print stripper is placed on one or more integrated circuits to secure the integrated circuits. An inked ink pad is then pressed against the one or more integrated circuits and removed therefrom. This action tends to develop electrostatic charge on the one or more integrated circuits. The charge may discharge from the pins of the one or more integrated circuits to the print stripper, potentially damaging the electronic devices integrated therein. The use of air ionizers and low tribocharge ink pads to address the foregoing has proved unsatisfactory.

DETAILED DESCRIPTION

Figure 1A:
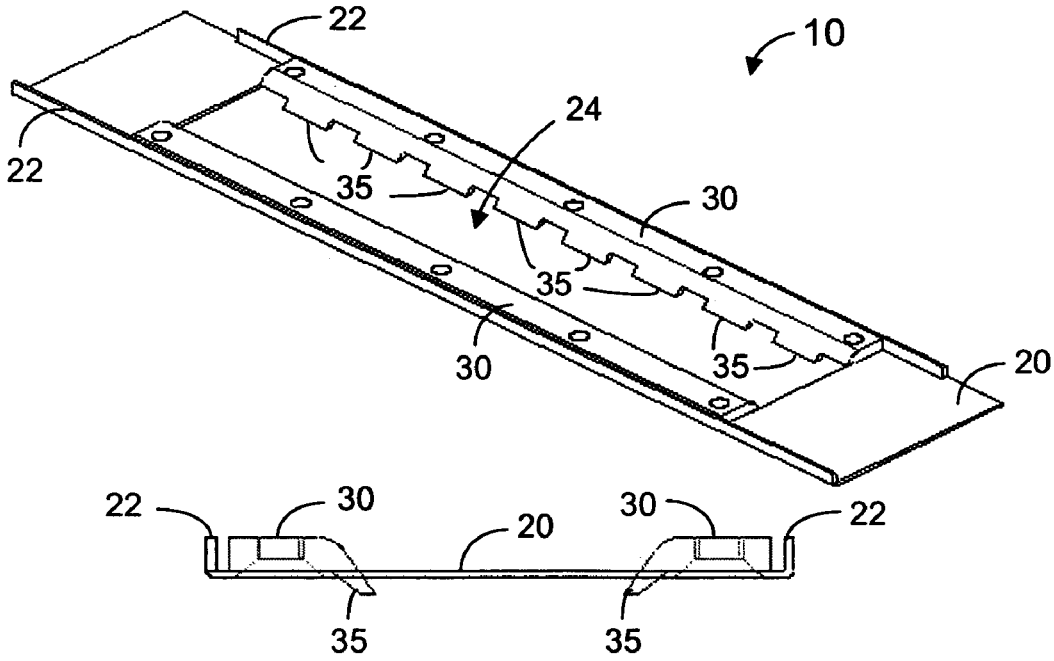
FIG. 1A comprises perspective views of the top and end of a static dissipative device according to some embodiments.
Figure 1B:
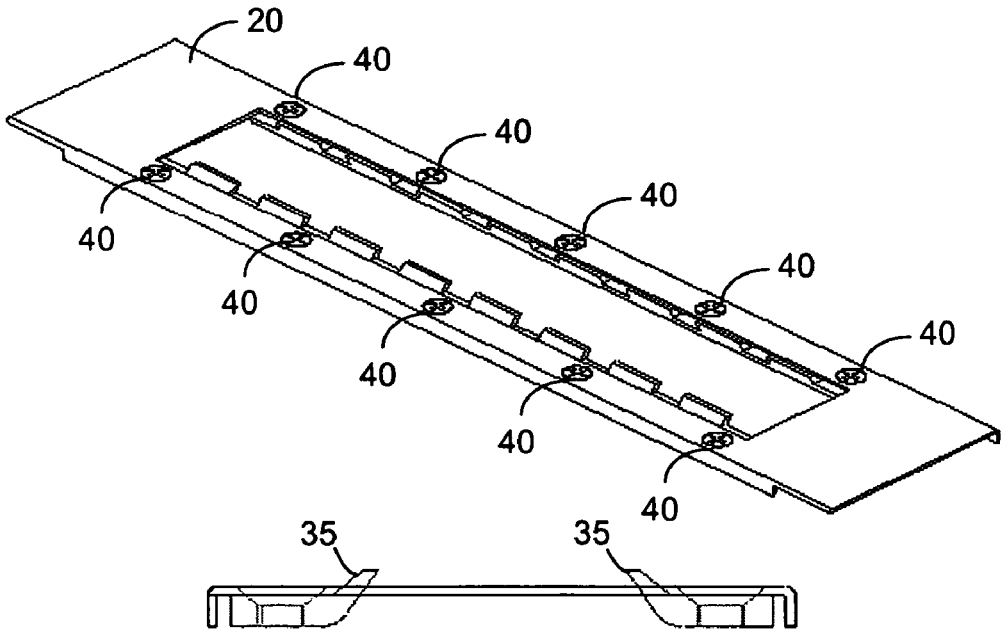
FIG. 1B comprises perspective views of the bottom and end of a static dissipative device according to some embodiments.

FIG. 1A shows top and end perspective views and FIG. 1B shows bottom and end perspective views of static dissipative device 10 according to some embodiments. Static dissipative device 10 may be used to secure a semiconductor component to an extent necessary to print indicia on the semiconductor component while the component is secured. According to some embodiments, device 10 comprises a print stripper.

Device 10 includes base 20 and support 30. Base 20 is illustrated as a substantially flat component that includes lips 22 and defines opening 24. Support 30 as illustrated includes flanges 35. Support 30 is coupled to base 20 via fasteners 40 such that flanges 35 extend through opening 24. Fasteners 40 may allow one or both of supports 30 to be replaced while base 20 remains in service.

In operation, flanges 35 secure semiconductor components while an ink pad passes through opening 24 to print indicia on the semiconductor components. Device 10 may control a dissipation rate of tribocharge-generated charge to the semiconductor components. According to some embodiments, device 10 comprises any combination of materials that exhibit a resistance of between $10^5$ and $10^{11}$ ohms per square. Device 10 may comprise an engineered plastic, examples of which include but are not limited to Semitron™.

Some embodiments differ significantly from device 10 of FIG. 1A and FIG. 1B. For example, base 20 might not include lips 22, may be differently-shaped and/or may define a differently-sized or shaped opening 24. Flanges 35 may be differently-sized and/or shaped and/or may be formed integrally with base 20. Many other configurations of device 10 may be used in conjunction with some embodiments.

Figure 2A:
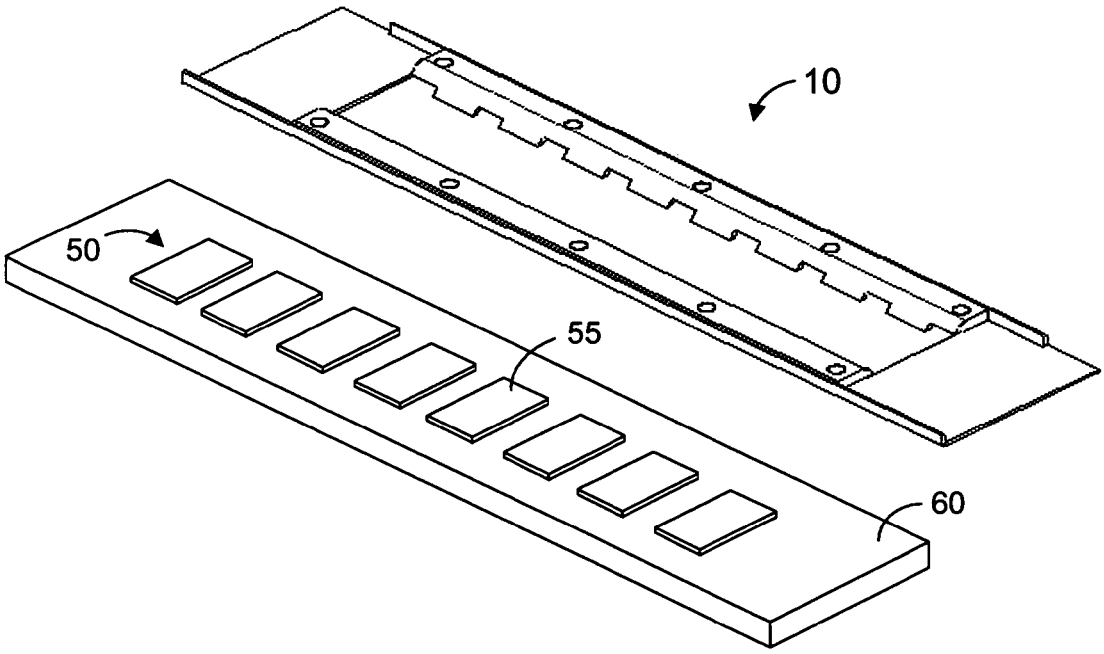
FIG. 2A comprises a perspective top view of a static dissipative device and a perspective top view of a plurality of semiconductor components disposed on a JEDEC tray according to some embodiments.

FIG. 2A illustrates a perspective top view of static dissipative device 10 and a perspective top view of a plurality of semiconductor components 50 disposed on tray 60 according to some embodiments.

Each of semiconductor components 50 may comprise an integrated circuit including an integrated circuit die and an integrated circuit package. The integrated circuit die may include integrated electrical devices and may be fabricated using any suitable material and fabrication techniques. The integrated circuit die may provide one or more functions, such as a memory, a microprocessor, or a chipset having a silicon substrate. The integrated circuit package may be electrically coupled to the integrated circuit die via wirebonds or electrical contacts, and may comprise pins or other external contacts. The integrated circuit package may comprise any ceramic, organic, and/or other suitable material.

Each of semiconductor components 50 also comprises cover 55 on which the indicia are to be printed. Cover 55 may comprise an element of the integrated circuit package, a heat spreader and/or another protective element. According to some embodiments, semiconductor components 50 comprise flash Thin Small Outline Package (TSOP) integrated circuits.

Tray 60 may comprise any device to support semiconductor components 50. Tray 60 may also be used to transport semiconductor components 50 during their manufacture. According to some embodiments, tray 60 comprises a tray conforming to standards promulgated by Joint Electron Device Engineering Council (JEDEC) for the handling of semiconductor components such as components 50. For example, in a case that semiconductor components 50 are flash TSOP components, tray 60 may conform to the March 1996 JEDEC Standard Outline entitled "TSOP (I) Thin Matrix Tray for Shipping and Handling."

Figure 2B:
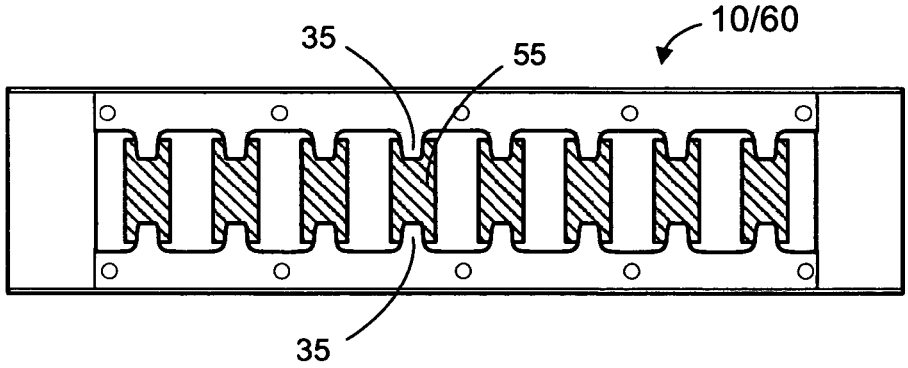
FIG. 2B is a top view of a static dissipative device securing a plurality of semiconductor components disposed on a JEDEC tray according to some embodiments.

FIG. 2B is a top view of device 10, covers 50 and tray 60 in preparation for printing according to some embodiments. Covers 55 are hatched in order to distinguish covers 55 from surrounding structures. As shown, each cover 55 is in contact with two of flanges 35. Such an arrangement may serve to secure components 50 to a degree necessary to allow proper printing of indicia thereon.

Figure 3:
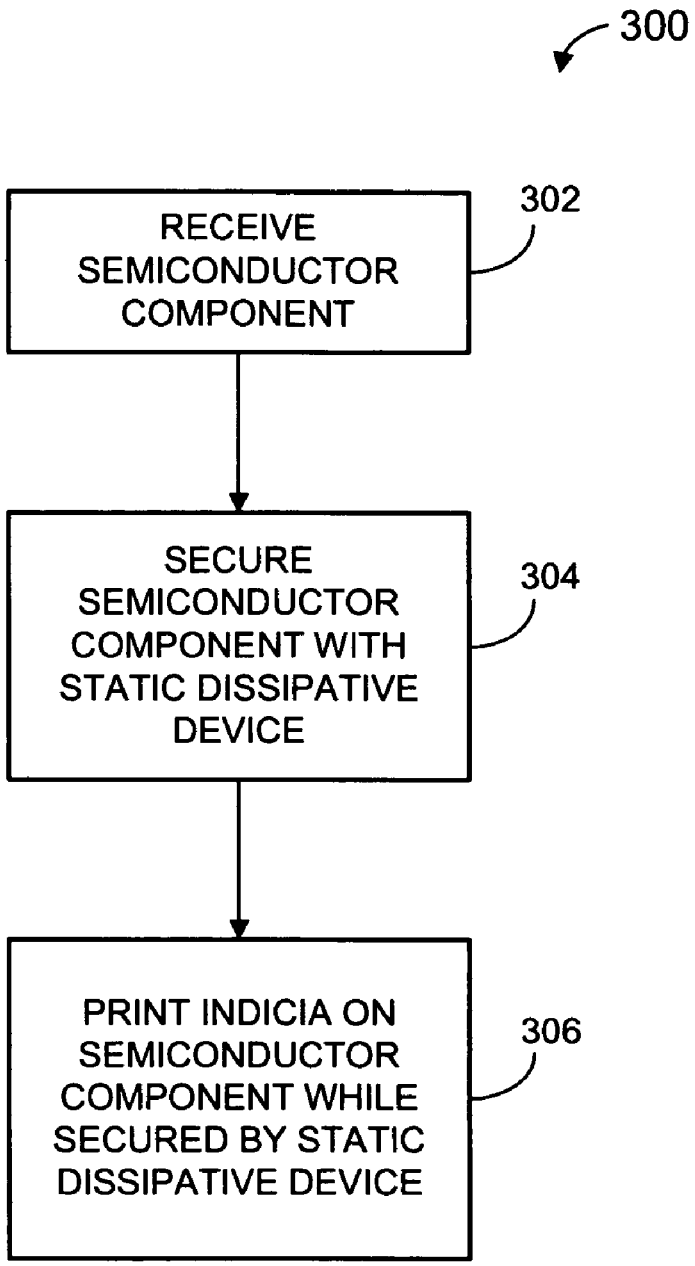
FIG. 3 is a flow diagram of an ink marking process according to some embodiments.

FIG. 3 is a flow diagram of process 300 to print indicia on semiconductor components according to some embodiments. Process 300 may be executed by one or more devices, and all or a part of process 300 may be executed manually. Process 300 may be executed by an entity different from an entity that manufactures the semiconductor components on which the indicia are printed.

Figure 4:
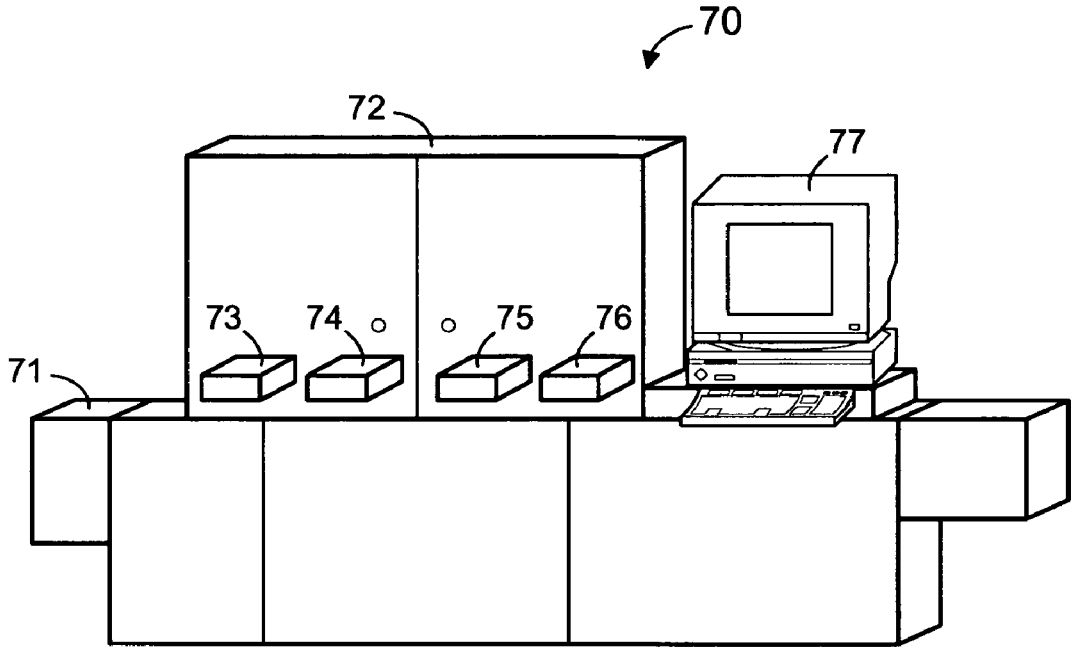
FIG. 4 is a perspective view of marking system according to some embodiments.

Initially, at 302, a semiconductor component is received for printing. The semiconductor component may be received along with one or more other semiconductor components on a tray as shown in FIG. 2A. FIG. 4 is a perspective view of marking system 70 for receiving a semiconductor component according to some embodiments of 302.

In some examples of 302, receiving unit 71 of marking system 70 receives tray 60 with semiconductor components 50 disposed thereon. Tray 60 is then transferred to housing 72 where cleaner 73 cleans a surface of components 50 using "flaming" techniques that are or become known. Tray 60 then moves to printer 74.

Figure 5:
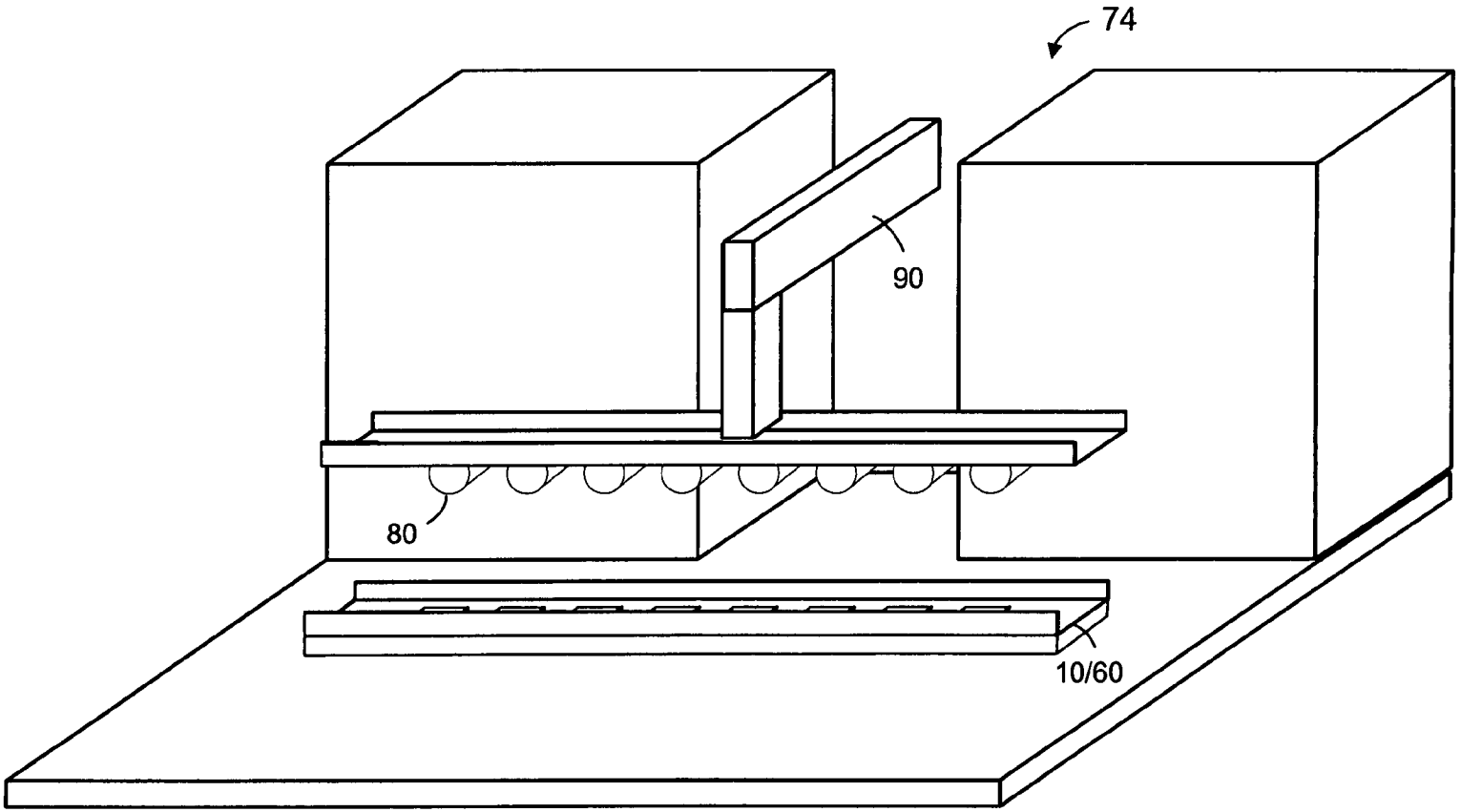
FIG. 5 is a perspective view of an ink pad, a static dissipative device and a JEDEC tray in preparation for marking semiconductor components according to some embodiments.

Returning to process 300, a semiconductor component is secured with a static dissipative device at 304. Printer 74 may include elements for placing static dissipative device 10 on components 50 so as to secure semiconductor components 50 against tray 60. FIG. 5 illustrates printer 74 according to some embodiments. FIG. 5 shows device 10 and tray 60 as arranged in FIG. 2A. Also shown are ink pad 80 and arm 90 supporting ink pad 80. According to some embodiments, ink pad 80 comprises silicon.

Figure 6:
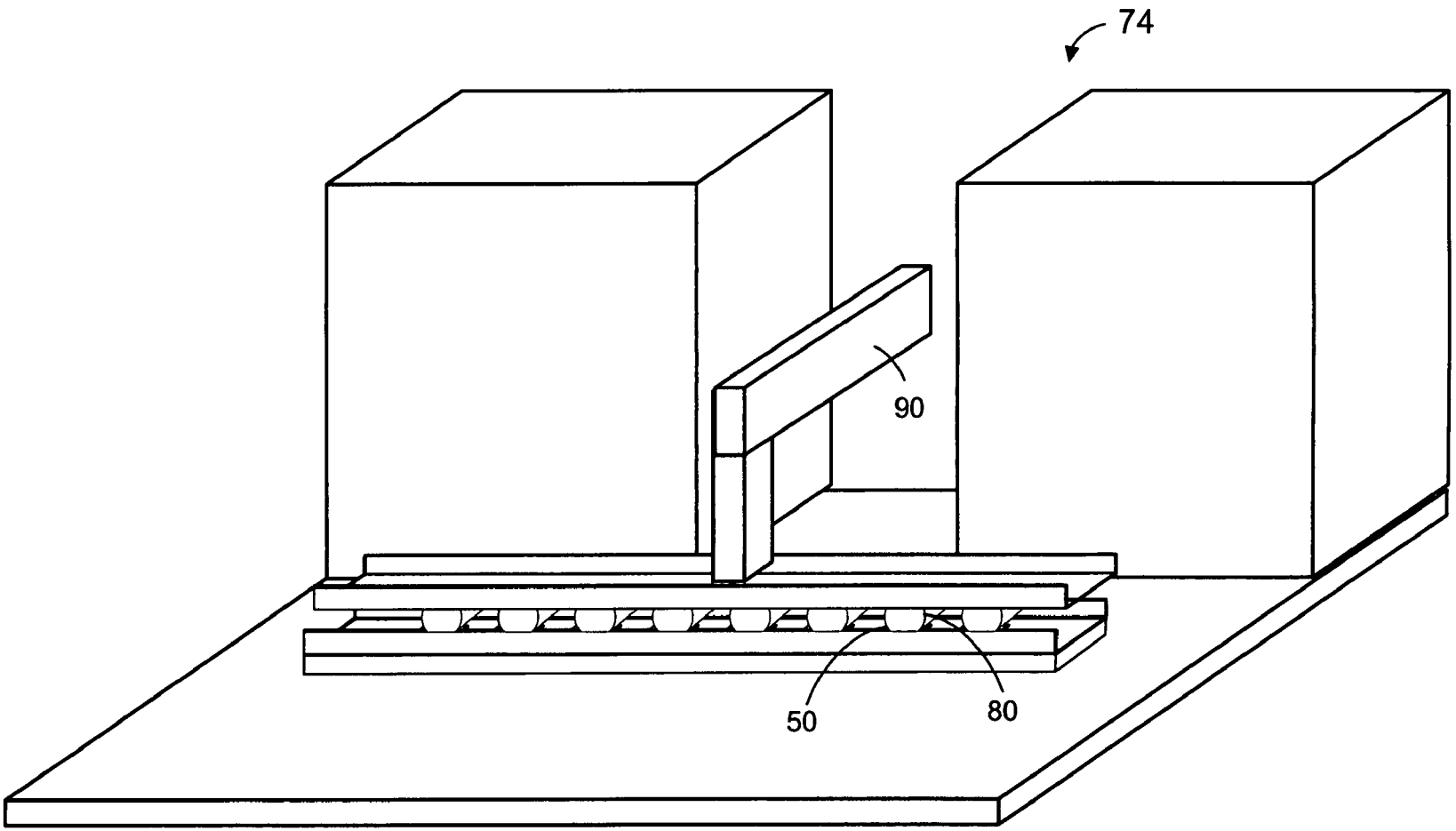
FIG. 6 is a perspective view of an ink pad, a static dissipative device and a JEDEC tray during the marking of semiconductor components according to some embodiments.

Next, at 306, indicia are printed on a semiconductor component while the static dissipative device secures the component. FIG. 6 illustrates printer 74 during some embodiments of 306. As shown, arm 90 has moved downward in order to bring ink pad 80 into contact with semiconductor components 50. Such action causes the printing of indicia on components 50.

In some embodiments, arm 90 is then moved to the position shown in FIG. 5. The contact and separation of ink pad 80 may generate charge on device 10. Device 10 according to some embodiments may control the dissipation of the charge to semiconductor components 50.

After the completion of process 300, tray 60 may be transferred to curing station 75 of system 70 for curing the indicia. Curing temperatures and times may depend on the specific fabrication techniques and materials used in various embodiments. Components 50 may then be inspected at inspection station 76 to confirm the printing operation. An operator may manually inspect one or more of components 50 using control device 77. Control device 77 may also control various elements of system 70 to operate, either automatically or under operator control, as described above.

The several embodiments described herein are solely for the purpose of illustration. The various features described herein need not all be used together, and any one or more of those features may be incorporated in a single embodiment. Some embodiments may include any currently or hereafter-known versions of the elements described herein. Therefore, persons skilled in the art will recognize from this description that other embodiments may be practiced with various modifications and alterations.

What is claimed is:

1. A system comprising:

a static dissipative device to hold a semiconductor component; and a printer to print indicia on the semiconductor component while the semiconductor component is held by the static dissipative device, the printer comprising:

an ink pad to contact the semiconductor component and the static dissipative device while the semiconductor component is held by the static dissipative device.

2. A system according to claim 1, further comprising:

a receiving unit to receive the semiconductor component; and a cleaner to clean a surface of the semiconductor component.

3. A system according to claim 2, further comprising:

an inspection station to inspect of the indicia; and a curing station to cure the indicia.

4. A system according to claim 1, wherein the static dissipative device exhibits a resistance between $10^5$ and $10^{11}$ ohms per square.

5. A system according to claim 1, further comprising:

a tray conforming to standards promulgated by the Joint Electron Device Engineering Council, wherein the static dissipative device is to hold the semiconductor component against the tray.

6. A system according to claim 1, wherein the ink pad comprises silicon.

7. A system according to claim 1, wherein the static dissipative device is to control a dissipation rate of tribo-charge-generated charge to the semiconductor component.

8. A system comprising:

a thin small outline package semiconductor component;

a static dissipative device to hold the semiconductor component; and a printer to print indicia on the semiconductor component while the semiconductor component is held by the static dissipative device, the printer comprising:

an ink pad to contact the semiconductor component and the static dissipative device while the semiconductor component is held by the static dissipative device.

9. A system according to claim 8, further comprising:

a receiving unit to receive the semiconductor component;

a cleaner to clean a surface of the semiconductor component;

an inspection station to inspect of the indicia; and a curing station to cure the indicia.

10. A system according to claim 8, wherein the static dissipative device exhibits a resistance between $10^5$ and $10^{11}$ ohms per square.

11. A system according to claim 8, wherein the static dissipative device is to control a dissipation rate of tribo-charge-generated charge to the semiconductor component.

* * * * *